US008764542B2

(12) United States Patent
Cram

(10) Patent No.: US 8,764,542 B2
(45) Date of Patent: Jul. 1, 2014

(54) GAME OF CHANCE UTILIZING WHEELS WITH PARLAY AND PROGRESSIVE JACKPOT OPTIONS

(76) Inventor: Jared Cram, Philadelphia, PA (US)

( * ) Notice: Subject to any disclaimer, the term of this patent is extended or adjusted under 35 U.S.C. 154(b) by 815 days.

(21) Appl. No.: 12/651,398

(22) Filed: Dec. 31, 2009

(65) Prior Publication Data

US 2011/0159942 A1 Jun. 30, 2011

(51) Int. Cl.
*G07F 17/32* (2006.01)

(52) U.S. Cl.
CPC ..... *G07F 17/3211* (2013.01); *G07F 17/329* (2013.01); *G07F 17/3258* (2013.01)
USPC ..... 463/18; 463/16; 463/27; 463/28

(58) Field of Classification Search
USPC ..... 463/16, 17, 22, 25–28
See application file for complete search history.

(56) References Cited

U.S. PATENT DOCUMENTS 6,921,072 B2 * 7/2005 Hughes-Watts ..... 273/142 E
7,549,637 B2 * 6/2009 Lease ..... 273/142 H
2005/0280208 A1 * 12/2005 Sorge ..... 273/146
2006/0249899 A1 * 11/2006 Lease ..... 273/142 R
2010/0120488 A1 * 5/2010 Savytskyy ..... 463/17

* cited by examiner

*Primary Examiner* — Arthur Hall
*Assistant Examiner* — Bach Hoang
(74) *Attorney, Agent, or Firm* — The Law Offices of Stephanie Shaya; Stephanie Shaya

(57) ABSTRACT

A game of chance and a method of playing a game of chance with a unique format and innovative wagering options, including parlay and progressive betting. At least one player must place at least one bet for the game to commence. Wagers can be placed on one event or multiple random events occurring simultaneously. Winning payouts are calculated based on the odds of the single event or the cumulative odds of multiple simultaneous events. The progressive bet can only be placed if another wager is simultaneously made, and is paid out as a separate bet. Once commenced, the game incorporates a plurality of random event generators to generate outcomes, which are paid out depending on predetermined payout odds. This game and method would be well suited for casinos in table, hybrid or electronic formats. This game could be played as a board game, a video game or a machine game.

10 Claims, 6 Drawing Sheets

GAME OF CHANCE UTILIZING WHEELS WITH PARLAY AND PROGRESSIVE JACKPOT OPTIONS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to devices and methods of playing a game of chance, which could be implemented in any of the following: a table game, a hybrid game, a machine game, an online game, a board game or a video game. More specifically, the present invention relates to a casino style game of chance utilizing a number of novel wheels, or representations of wheels, wherein garners can place individual bets, progressive jackpot bets or parlay bets all within the same game.

2. Background of the Invention

The gaming industry has expanded dramatically over the years, as people have more free time and disposable income to gamble. Constantly, the gaming industry has sought development of new games that would increase user amusement and satisfaction, and therefore generate more revenue for the game provider or operator. However, over the years, generally the same games have been played with little variations. Variety on the casino floors could draw different garners to the casino, as well as provide a new outlet for enjoyment for traditional game players.

Many games of chance are well known, including roulette, blackjack, slot machines, wheel of fortune, poker, the BIG 6 wheel and daily lotteries. These games of chance generally have a limited number of wagers. Games such as craps are difficult to learn and may not attract as many players due to the complexity of the rules. An easily understood game allowing for multiple unique wagers would create more player enjoyment and involvement.

Some currently available games provide the use of wheels or reels to create a winning event and award the player a prize. Other games offer players the option of placing a progressive jackpot bet. Very few games provide players the option of a parlay style bet, which could increase enjoyment for garners who are interested in more than conventional independent betting systems. Further, many of these games may have complicated rules or few wagering outcomes available.

3. Description of the Related Art

Often, the teachings of the prior art use methods and devices to implement progressive jackpots, however these games are generally associated with a conventional game and do not adequately generate a wide variety of unique wagering options, and therefore do not adequately excite or entice gamers. Progressive jackpot games are well known in the prior art, generally in the form of card games. Often the player can make a wager on a card game to enter the game, and the player can make an additional optional wager on a progressive jackpot component of the game. If the player's hand comprises a predetermined arrangement of cards and the player has opted to make the second wager, the player will be awarded the preselected portion of the progressive jackpot prize. U.S. Pat. Nos. 4,861,041, 5,626,341, 5,707,287, 5,795,225 and 5,951,011 all describe methods of progressive betting methods in card games. U.S. Pat. No. 5,275,400 describes a method of playing an electronic pari-mutuel gaming device that can display credits a player accrued and allocate a progressive jackpot among players pooled together in linked electronic gaming systems. Further, Richard J. Jordan, (U.S. Pat. No. 6,416,409) teaches of a system and a method of providing a progressive bonus from a wager pool to devices in a set of linked gaming machines, where each machine has a designated bonus outcome, and can produce the outcome after determining that the pool is large enough to produce the determined prize. U.S. Pat. No. 4,998,199 discloses a plurality of independent game machines connected together to allow transmission of data so players can play a game at the same time, however, it does not suggest or teach of allowing players to engage in progressive betting or parlay betting styles. All these games from the prior art may implement progressive jackpots to more traditional games, which increases wagering options by the progressive wager, but does not add additional variety to the casino floor.

Some progressive games include wheels, but still do not elicit user excitement because they are generally associated with conventional games or bonus wheels and do not provide unique forms of game play. Progressive jackpots are occasionally implemented in games with wheels. Busch et al. (U.S. Pat. No. 6,059,659) describes a method of playing roulette, including a roulette wheel, a conventional betting layout and a progressive jackpot layout. This invention combines the progressive betting layout with a game including a wheel. However, this game is still a variation of the conventional roulette game, and does not provide a novel gaming layout, a novel betting layout, nor does it teach of using multiple wheels containing novel symbols for unique game play. Similarly, U.S. Pat. No. 5,743,798 teaches of a roulette game which offers a progressive jackpot wager through utilization of a plurality of coin acceptors to enable players to place an optional progressive jackpot wager. As in the '659 patent, the '798 patent does not teach or suggest the novel layout of the current invention, and does not incorporate a parlay betting scheme. Further, Richard G. Eman et al., (U.S. Pat. No. 5,588,650) describes an automated roulette device with a central processor and a progressive jackpot. These games incorporating progressive jackpots to conventional betting formats, which expands wagering options and user amusement to an extent, but still implements traditional game rules and odds, reducing variety of game play.

Many games incorporate wheels or reels to generate a random event, however, these games are often limited in wagering options, and consequentially are limited in player interest and amusement. Webb et al., (U.S. Pat. No. 7,431,649) discloses a gaming system with at least one input, at least one display, a processor, and multiple selection indicators, that cause at least one of the symbol indicators to indicate an award symbol. The award indicator can take the form of a wheel, with symbols representing different prizes. This feature of using a bonus wheel to determine additional prizes is somewhat common in gaming. Further, the teachings of Paulina Rodgers et al. (U.S. Pat. No. 7,425,177) describes a gaming device operated by a processor, including a primary wheel with a plurality of sections, associated with a modifier and different characteristics, and a plurality of secondary wheels with sections each associated with a value to activate the primary wheel and provide a prize. These inventions incorporate a basic gaming format, and do not allow a gamer to place a wide range of wagering options, thereby limiting gamer excitement.

Spinning reel games are well known in the prior art, and often utilize a number of cylindrical reels, containing symbols on their outer circumferences, that rotate about an axis in response to a gamer activating the game. When the reels stop spinning, the gamer can win a prize if the reels provide a particular configuration of symbols that designate a winning configuration. For example, U.S. Pat. No. 5,947,820 discloses a hierarchy of simulated wheels which are used to simulate the spinning of a slot machine reel to display a winning combination of puzzle pieces. Other patents using reels and wheels in casino include U.S. Pat. Nos. 5,823,874 and 5,848,932, which contain wheel bonus games, with a static indicator, such as a stationary pointer, that remains motionless while the mechanical wheel rotates. Reel games often do not provide gamers as many wagering options as wheel games, since a wheel allows more symbols to be located about its circumference.

The teachings of U.S. Patent Application Publication No. 20090137303 A1 disclose a device consisting of a vertically oriented hollow enclosed wheel rotated at a constant rate with a series of cavities along the inner surface of an enclosed wheel's periphery to prevent the game pieces, such as elastic balls, from falling out, as the player attempts to time the release of game pieces from a holding area into a particular cavity to trigger a signal and win a prize. Marnell et al. (U.S. Pat. No. 5,188,363) discloses use of a "WHEEL OF FORTUNE" wheel as a variation to an electronic poker or other card game. Tjark Bergmann (U.S. Pat. No. 5,259,616) discloses a process for operating a slot machine that works as a roulette wheel. Barbara Mangano et al. (U.S. Pat. No. 6,059,658) describes a bonus game device and method with a primary and a secondary gaming structure, each with five concentrically arranged wheels each containing symbols of an Ace, King, Queen, Jack, Ten and a wild symbol. Morro et al. (U.S. Pat. No. 6,162,121) discloses a computer implemented game process of controlling a display of an image outside the housing. Additional patents using reels and wheels include U.S. Pat. Nos. 5,823,874 and 5,848,932. Further, U.S. Pat. No. 6,533,660 discloses a game with a plurality of balls and a jumbler, which could be a wheel to create the winning outcome.

Some patents cover the structure of gaming wheels. One such patent, by inventor Ah-Him Chong Toc Chee, (U.S. Pat. No. 6,164,647) explains a roulette assembly with a lower wheel divided into a plurality of sections, each representative of at least one of a unique number and a unique color and an upper wheel, containing many unique sections, mounted on the lower wheel so that the two wheels spin and rotate until they slow to a stop together indicating a unique number and color combination. Another patented wheel game describes an alphabetic roulette game taught by Ilievski (U.S. Pat. No. 7,204,488) including a roulette wheel with twenty-five positions, each representing the twenty-six letters of the Roman alphabet, with one position having a double letter. The alphabetic positions on the wheel correspond with positions on a table or other wagering surface and may be colored to allow players to place wagers on letters or colors.

Some games incorporate use of wheels with an internal indicator allowing the wheel to stop at a predetermined outcome on the wheel. One such game is defined in U.S. Pat. No. 7,226,357, invented by Olaf Vancura. The '357 patent discloses a method of using a processor to operate a vertically oriented mechanical wheel casino game assembly utilizing a freely moving internal indicator, such as a ball, within a housing, that can freely and randomly move into one possible outcome segment in a plurality of possible uniform outcome segments, each representing a value and containing a sensor under the control of the processor to award a winning payout. Similarly, U.S. Patent Application 20070155481 A1, also invented by Olaf Vancura, explains a method of operating a casino game of chance with a mechanical housing divided into a plurality of segments wherein the mechanical housing is spun under control of a processor, a freely moving internal indicator randomly selects one set of possible outcome sets from a plurality of uniform sets located in the mechanical housing at a predetermined location, sensed by the processor and associated with an award.

A few games implement a plurality of wheels to create more random events; however, said games generally are extensions of traditional games and often do not allow multiple different forms of wagering options. The teaching of Hughes-Watts (U.S. Pat. No. 6,921,072) discloses a method and apparatus for betting on a plurality of roulette wheels that are spun simultaneously. The indicia on the disclosed invention relate to roulette. A game of chance that involves unique indicia is described in Luciano et al. (U.S. Pat. No. 6,561,512) including a gaming device with a plurality of separate groups of rotatable wheels, each group having a plurality of rotatable wheels with a viewable annular surface with at least one indicia on each of the viewable annular surfaces, at least one pay line Further, the patent discloses a drive mechanism to rotate the plurality of wheels and stop the wheels in a position wherein the occurrence of a predetermined combination of the indicia on the pay line creates a winning combination. This invention relates to concentric wheels and groups of wheels in a combined structure, and does not teach of implementing a progressive jackpot nor does it teach of parlay betting, and is therefore limited in wagering options.

Few games incorporate parlay betting, and even fewer are available on the casino floor. Most parlay bets that are available are offered in sports books. Some patents, however, do cover methods of parlay betting, such as U.S. Patent Application Publication No. 20080054560 A1, which discloses a method of playing a game of chance comprising placing at least one wager on at least one number from a plurality of wagering zones on a game board, table, computer screen, or electronic game screen, that generates a first number set, that when added together produces a sum, wherein the wager will win if the sum matches one of said plurality of numbers chosen in the wagering zone. The method further provides for parlaying at least a portion of a first wager and betting in a second wager that a second number set, having at least two numerical members, will match the first number set. Although this invention teaches of using a parlay bet in combination with a table game, it requires generating number sets and adding together their values. Additionally, the invention does not disclose a progressive jackpot feature.

The teachings in Potter, et al. (U.S. Pat. No. 6,692,003) disclosed a method of a parlay side bet added to a base casino game wherein a player places a side bet prior to playing the base game. If the outcome of the side bet results in a win, the side bet is increased and parlayed into the base casino game as a wager. If the side bet game results in a push, the side bet is parlayed into the base casino game as a wager and the base game begins. However, if the outcome of the side bet game is a loss, then the player loses the side bet, but may place another wager for the base game. Patent application publication, U.S. 20030207706 A1 discloses a side bet system method integrated with a casino game wherein a player places a wager to participate in a side bet, that may result in a win to be paid out a predetermined amount and applied to the base casino game, or may result in a loss of all or some of the side wager, where the remainder will be applied to the base casino game. Similarly, U.S. Pat. No. 6,997,805 provides a method for operating two bonus games in a casino game machine having a multi-reel, multi-pay line casino base game, where play of the first and second bonus games is based on predetermined orientation of bonus symbols during the base game. Although all these games add a parlay wagering option to a conventional game layout, thus expanding wagering options, the games do not incorporate new gaming layouts.

Frequently, games are limited in the amount of random event generators used. For example, U.S. Patent Application Publication No. 20090156284 A1 provides a game and a method with wagering numbers and/or letters, and/or symbols and/or colors and/or groups of these upon which players can place bets, a random number generator to generate a winning number, identifiable playing chips allowing each player to make multiple identifiable bets on the board, wherein the winner of the entire jackpot is the player or players that placed the bet on the winning position or closest to it.

Valenti (U.S. Pat. No. 6,722,978) describes a method of playing a numerical game of chance including a parlay and a bonus option, wherein the player selects a series of five numbers from a set of eighty numbers and makes a wager, and then does it again, making another wager. The player is given the option of combining the first series of five numbers and second series of five numbers with a wager. This gives a player multiple ways to win and allows for parlay bets, while still having limited indicia to wager upon, since this game is limited to numeric indicia.

Further, patent application publication, U.S. 20050208996 A1 defines a method of implementing a wagering game, including receipt of cash, conversion into playable money, a player wagers on two or more independently determined events with varying odds and wager amounts, and the outcomes of the events are determined. Similar inventions, U.S. Pat. No. 7,367,562 and U.S. Patent Application Publication 20090250872 A1 teach of a method of playing a game of chance comprising the steps of having at least one player wager at least one wager in a set of wagers, defining a set of wagers on the result of a plurality of differentiable random events, where the events make an aggregate event, defining a set of payout odds associated with the wagers, then generating the plurality of differentiable random events, and paying out winning wagers according to the payout odds described above. Double wagers are based on non-equal, non-consecutive, non-sum total combinations of two outcomes from only two random events selected and trifecta wagers are based on non-equal, non-consecutive, non-sum total combinations of three outcomes from only three random events. Additionally, the inventions disclose that the random event may be generated by many means, including by one or more prize wheels or one or more roulette type wheels. This invention allows for parlay betting of aggregate groups, but does not disclose a progressive jackpot between multiple players, and actually suggests that players would feel uncomfortable and dislike wagering against other players, as would occur during progressive gaming.

BRIEF SUMMARY OF THE INVENTION

The aforementioned needs are attained through the following inventions:

The present invention relates to a new and useful game of chance and method of playing said game of chance. More specifically, the present invention relates to a game of chance and a method of playing a game of chance with a unique format and innovative wagering options, including parlay betting and a progressive betting option. This game and method would be well suited for casinos in table format, an electronic format, or in a hybrid format. Additionally, this game could be played as a board game, a video game or a machine game.

The game and method of this invention are particularly well suited for implementation as a casino game. By offering an option for parlay bets on the casino floor, more guests will be interested in entering the casino floor, and have a more rewarding gaming experience. In addition, since parlay bets have odds that are more favorable to the house than the odds of independent bets, casinos or other game providers will benefit from increased house edge that are more attractive to guests.

The wagers can be based on the outcome of one event or multiple random events occurring simultaneously. Random events can be generated a single time simultaneously to create outcomes for all independent, parlay and progressive wagers placed for a particular turn of the game. In contrast, random events may be generated more than once simultaneously for a particular turn, wherein each different generation of events may correspond to different wagers placed. For example, events may be simultaneously generated twice, wherein the first generation of events corresponds to independent and parlay wagers, and the second simultaneous generation of multiple random events corresponds to progressive wagers.

The game allows for many different wagers to be placed with the options of independent bets including wagering on individual numbers, hi/low, even/odd, hi-odd, high-even, low-odd, low-even, and other combinations, where zero is considered an even number. Parlay bets can be placed on two or more events occurring simultaneously, where the events include individual numbers and may additionally include hi/low, even/odd, hi-odd, high-even, low-odd, low-even. Bets on just one random event can be placed by a player in the parlay area of the game board; however, such bets will be treated as independent bets for calculations of payout odds, since true parlay wagers will pay out based on payout odds of combined random events occurring together. The progressive bet can only be placed by a player who also places at least one individual bet or parlay bet on the same game turn. The progressive bet payout is determined by the operator of the game, and will pay out an accumulating progressive jackpot when a winning progressive bet is placed for a particular turn. Progressive jackpots will include matching multiple indicia, such as jokers, colors, and other non-numeric indicia. Further, the cost to place a progressive bet wager will be set by the operator, such as a casino, parlor, video game provider or board game provider.

Winning payouts of independent and parlay bets are calculated based on the odds of the single event or the cumulative odds of multiple simultaneous events. Winning independent and parlay bets are paid out according to odds calculated as the true odds of the numeric outcome being generated without including the likelihood of generating any symbol outcomes in the payout calculation. Therefore, payouts are calculated as what the odds of each outcome would be as if the wheel contained no symbols for the progressive jackpot. For example, the odds of choosing the right number from 0-9 would be 10:1, so that is the payout of a random event generator containing 10numeric outcomes, regardless of how many symbol outcomes are present. The addition of the extra symbols makes the actual odds less likely than the payout calculation odds, creating the house advantage. The progressive bet is paid out as a separate bet based on cumulative simultaneous random events, and has a progressive payout, set by the operator of the game, such as a casino. Further, in order to place a progressive jackpot bet, another wager must simultaneously be placed by the same player on the board, or representation of a board, for that turn of playing the game. Although in order to place a bet on the progressive jackpot, a player must place an independent or parlay bet of some sort, once the bets are placed, they are treated independently, meaning, a player can lose on the non-progressive bet while winning the progressive bet.

Some preferred embodiments of the invention involve table games. One preferred embodiment of a table game includes a board with multiple wagering zones for placement of bets, wherein each wagering zone is associated with payout odds. Pay outs will be paid to successful players according to payout odds. In the case of table games, a progressive jackpot that is started at an original amount and increased by a percentage of each bet placed by every player at that particular table thereafter. The original amount for the progressive jackpot and the percentage it is increased by with each bet placed are determined by the operator, such as a casino or parlor. Still in the table game embodiment, the progressive jackpot is paid out in equal shares to all players who have placed a winning bet on the progressive jackpot for that particular wager at that particular table. The cost to place the progressive bet will be set by the operator, such as a casino.

Another preferred embodiment of the invention involves electronic games that are linked together and implement the same random number generator(s), such as physical wheels or representations of wheels, air-mix style random number generators, and pseudo-random number generators. There exist two variations where the game is being conducted in an electronic format, where the random number generators implemented are identical novel wheels and where multiple machines are connected to the same wheels. The first variation is a hybrid game format, which consists of electronic components, such as an electronic display, including an electronic input system, such as a keyboard or a touch screen, and a progressive display, however, the random event generators are still physical wheels that contain sensors to detect the resulting values generated and then communicate this back to the electronic system for calculation and distribution of payouts. The second variation includes an entirely electronic game, including a fully electronic display with an electronic wheel display, an electronic input system, such as a keyboard or touch screen, and progressive display. The electronic wheel display can implement pseudo-random number generators for generation of the random events. In either variation of the game, the payout functions the same as in the table game, wherein the winning progressive bet will pay out in equal shares to all players who have placed a winning bet on the progressive jackpot for that particular turn of the game, at that particular group of linked gaming machines.

Further, in an electronic format of one or more linked gaming machines or computers, the electronics may include two wager detectors to detect that at least one base wager, in the form of an independent wager or a parlay wager, has been placed and a detector to determine whether a progressive wager has been placed. Each machine will have two corresponding detectors at the player terminal. Since a progressive wager can only be placed after a base wager is placed, the detector will prevent attempted progressive wagers without a base wager. Additionally, since the progressive jackpot is funded by a percentage of each wager placed through all said linked gaming machines or computers, detection devices for each wager will assist in communicating what contributions should be added to the progressive jackpot.

A method of playing a game of chance is disclosed with a preferred embodiment having the steps of at least one player placing at least one wager in the form of an independent or parlay wager and at least one player having the option to place progressive bet wagers if that same player has placed an original wager in the form of a an independent or parlay wager. Additionally in the preferred embodiment of the method, a single or multiple simultaneous random events are generated by at least one random number or event generator, results are evaluated, any successful independent or parlay wagers are paid off according to predetermined odds, and any successful progressive bet wagers are paid off at a rate determined by the operator and split among all successful progressive bet players.

Wagers may include a plurality of wager options, wherein said wager options pay outs are based on the results generated by a plurality of random number generators. In one preferred embodiment each random number generator is associated with an independent wagering group, where a player may chose any within that particular independent wagering group to place a wager on that particular random event generator. Wagering groups are further broken into wagering zones. Wagering zones are located on the game board, game table, or representation of a game table, such as on a screen in electronic gaming. Additionally, a wagering group for combined bets, otherwise known as parlay bets, is available with its own set of wagering zones. Further, an additional wagering group is available for progressive gambling, containing a progressive gambling zone for placement of such bets.

Wagering options include placing at least a first wager option in a wagering zone of a wagering group of a table, board, computer screen or electronic representation of a game board layout. The first wager can be based on a single random event, or on multiple random events. Unlimited wagers can be placed as independent wagers or as parlay wagers on different blocks on selected areas of a gaming board or representation of a gaming board. Each random number generator is associated with a wagering group, where a player may chose any zone within that particular wagering group to place a wager on that particular random event. Additionally, once at least a first wager is placed in the game, a progressive wager may be placed in the corresponding progressive wagering zone.

For example, one preferred embodiment includes three random number generators. In this embodiment, a wager can be placed in one or more independent wagering groups, on a wagering zone. The game board, table or electronic layout for this embodiment would have a total of five wagering groups. Of the five wagering groups, three wagering groups would be associated with a particular random number generator. Each wagering group associated with a random number generator would be further broken up into multiple wagering zones, for independent wagers to be placed on wagering zones within the wagering group, including wagering zones with the values of individual numbers, hi/low, even/odd, hi-odd, high-even, low-odd and low-even. Additionally, of the five wagering groups, one wagering group would be for parlay bets, and would be further broken up into multiple wagering zones representing potential outcomes for all three random number generators to allow for combined game play, including zones with potential values of individual numbers, hi/low, even/odd, hi-odd, high-even, low-odd, and low-even. The final wagering group of the five groups in this embodiment would be a progressive betting group which may be broken into progressive betting zones for playing to win a progressive jackpot.

In the example above including three random number generators, wagers may be placed on a single wagering zone or on multiple wagering zones of any of the three independent wagering groups, and/or on a single or multiple wagering zones of the wagering group associated with parlay bets. Unlike in independent bets, where a single wager relates to a single event, parlay bets on more than one random event generator will be combined together, such that all wagers are considered a combined wager and must be generated by the random event generators in order for the parlay bet to win. Once at least one independent bet or parlay bet has been placed, a wager may be placed in a wagering zone of the wagering group associated with the progressive bet.

The plurality of random events may be generated by any means of random event generators including the use of one or more wheels, one or more air mix style random number generators, one or more electronic random number generators, one or more pseudo-random number generators, hardware random number generators, one or more random event generators and other means to generate random outcomes.

Embodiments implementing wheels or electronic representations of wheels are particularly well suited for this game. Stich wheels or representations would be of novel identical wheels, wherein the wheels contain segments with indicia on them that correspond to places on the novel betting surface. Wheels could be oriented horizontally, vertically or along another axis. Wheels may be enclosed or open, and may use pointers or objects, such as balls to determine the random event.

BRIEF DESCRIPTION OF THE DRAWINGS

Preferred embodiments of the present invention are described in detail below so that those having ordinary skill in the art pertaining to games of chance will understand how to make and use the subject invention. In no way, however, do the preferred embodiments limit the scope of this invention.

DETAILED DESCRIPTION OF THE INVENTION

Figure 1:
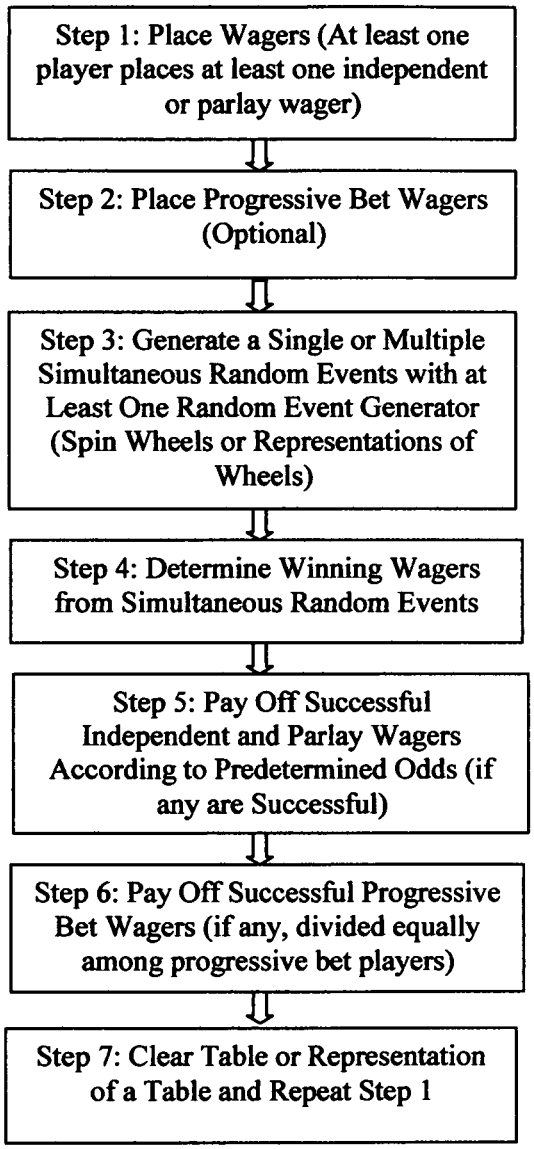
FIG. 1 depicts in a flow chart format a preferred embodiment of the method of playing the game of the present invention.

Very few games in the prior art satisfy the need for a game that could be played on the casino floor that incorporates the ability to bet individually, in parlay and on progressive jackpots all within the same game. The present casino-style game invention provides a novel solution of increasing wagering options, while escalating player amusement and involvement, by adding a new game layout which would increase variety of wagers available on the casino floor. In one preferred embodiment the current invention discloses the use of a novel plurality of wheels. The wheels may be vertical or horizontal, actual or apparent, and will contain matching indicia, where the wheels may be identical, and can be spun individually or in combination, simultaneously. Players can place bets on corresponding portions of a novel gaming table or table representation.

Referring to the figures and preferred embodiments of the invented game of chance is to provide clarity to understand the invention, but in no way is intended to limit this game to such embodiments. While several examples of the invented game are given and describe using a plurality of wheels as the random event generators, this invention is not limited only to wheels, and can implement a variety of random event generators, including but not limited to air mix style random number generators, electronic random number generators, pseudo-random number generators, gravity fed random number generators and hardware random number generators. The game could even implement special dice with fifteen sides and untraditional numbers and symbols on each surface.

One preferred embodiment of the invention allows novel wheels with matching corresponding symbols to be spun simultaneously to create a single bet, a parlay bet and a progressive jackpot bet, wherein the single or parlay bets may be made by at least one player and the progressive bet may be placed by a player that has at least one additional bet elsewhere on the game board or representation of a game board in the case of electronic gaming.

Many current gamblers consider parlay betting to be exotic. Parlay bets can generate extremely high outcomes with very little wagering amounts. However, most parlay style games are only available in sports books gambling. The present invention offers the option of a parlay bet on the casino floor for garners who are interested in game playing that depends on at least one player placing a bet on the combined outcome of at least two random events generated simultaneously to win a larger payout. By offering an option for parlay bets on the casino floor, more guests will be interested in entering the casino floor, and have a more rewarding gaming experience. Further, since players can win much higher payouts with lower wagers, more players may be enticed to play more rounds in attempts to win larger payouts. In addition, the parlay bet has odds that are more favorable to the house than independent bets, so the casinos or other game providers will benefit since the house edge will be increased on bets that are more attractive to guests.

Referring now in detail to the drawings, FIG. 1 represents, in a flow chart format, a preferred embodiment of the method of playing the game of the present invention, with the chronological steps of players first placing wagers, wherein at least one player places at least one independent or parlay wager, then players who placed at least one wager are given the option of placing a progressive bet wager, and next a single or multiple simultaneous random events are generated with a random number generator, such as wheels being spun or pseudo-random number generators are activated to generate random events associated with representations of wheels in an electronic version of the game. Further, the flow chart of FIG. 1 depicts that after the generation of one or more simultaneous random events, winning wagers are determined and parlay and independent wagers are paid out according to predetermined payout odds, and progressive wagers are paid out at the rate of the progressive jackpot, and divided by all progressive bet players at a table or linked gaming machines or computers for a particular round of game play. Finally, the table, or electronic representation of a table is cleared and the first step is repeated.

Figure 2:
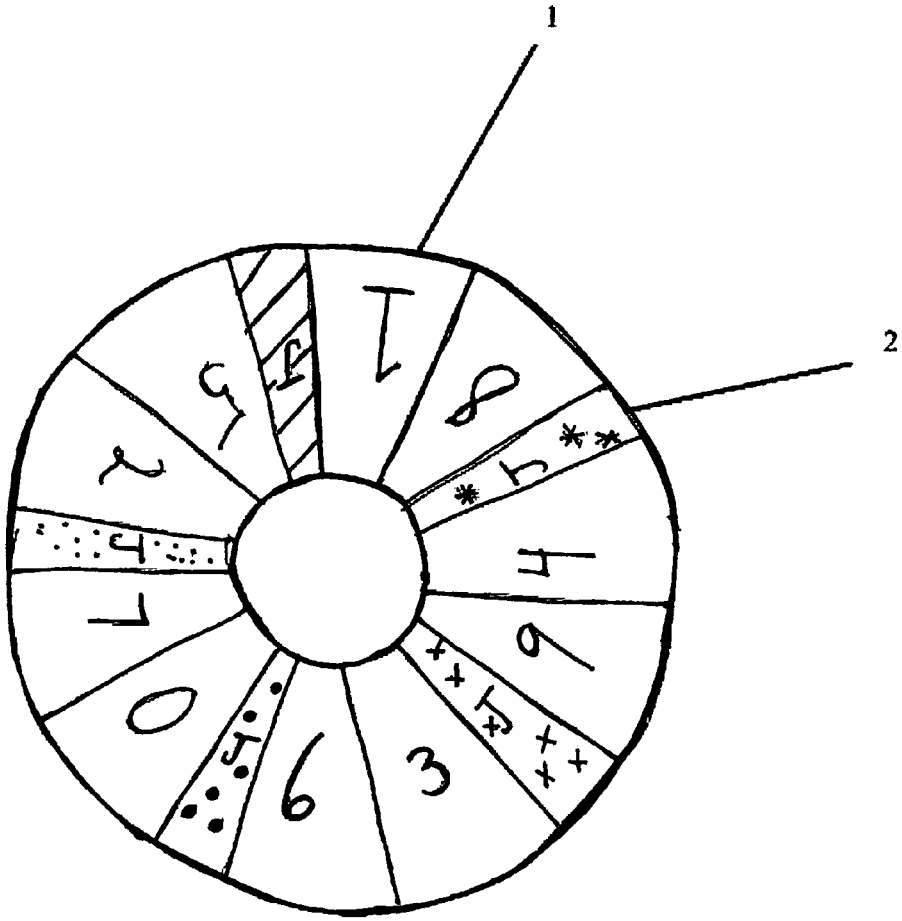
FIG. 2 displays a preferred embodiment of a wheel layout to be used as a random number generator. This wheel could be a physical wheel or an electronic representation of a wheel.

In FIG. 2, the illustration depicts a preferred embodiment of a wheel layout to be used as a random number generator in the present invention. This wheel is divided into fifteen radial sections 1 and 2. Ten of the fifteen sections contain the numbers zero through nine and are of the same size 1, and five of the fifteen total radial sections 2 contain a joker of a different color and are of equal size, but smaller than the ten numeric sections. The larger radial sections 1 are randomly oriented about the wheel in groups of two, each group of two larger sections 1 are divided by a smaller joker section 2. Although FIG. 2 illustrates the layout of a novel wheel for game play, the game utilizes a number of novel identical wheels spun simultaneously.

In the wheel preferred embodiment of FIG. 2, the wheel is round and can be oriented vertically, horizontally or on an angle. In the horizontal orientation the wheel can have a stationary indicator, such as a pointer or a freely moving indicator, such as a ball of an appropriate size to fit the five smallest radial sections 2 containing jokers. The wheel may be open or enclosed in a clear casing, such as one made of plexiglass. The wheel can have a raised center for manual spinning. The wheel can have prongs or ridges on the outer periphery for manual spinning.

In the vertical orientation, the wheel can implement a stationary indicator, such as a pointer, which can be exposed to air or enclosed in a clear enclosure, such as one made of plexiglass. The stationary indicator can be oriented anywhere about the wheel, and come into contact with the most peripheral portions of the radial sections of the wheel, so that when the wheel is spun, it will come to rest by the force of gravity and the pointer will be oriented in a radial section when the wheel comes to rest. Such resulting section will generate a random outcome for game play. Additionally, in the vertical orientation the wheel can implement a freely moving indicator, such as a ball of an appropriate size to fit the five smallest radial sections 2 containing jokers. The vertically oriented wheel with a freely moving indicator must be enclosed in a clear housing, such as one made of plexiglass, so the freely moving indicator will remain in the wheel housing. When the wheel is spun, the free-motion indicator, generally a ball inside the wheel, is disturbed and made to bounce inside the wheel housing, and then comes to rest in a radial section when the wheel is brought to a stop, either by the force of gravity or an electronic signal. The resulting final resting section of the ball in the wheel determines the random event. Further, the wheel can have a raised center for manual spinning. The wheel can have prongs or ridges on the outer periphery for manual spinning. Further, the wheel could be connected to an electronic mechanism and be spun through electronic activation. These characteristics would be the same for a wheel oriented at an angle.

The wheel in FIG. 2 could be a physical wheel or an electronic representation of a wheel. In the electronic representation, the wheel will be an image on a computer screen or gaming machine screen and have the same visual elements of the physical wheel.

The wheel of FIG. 2 additionally can be divided such that the ten numeric radial segments 1 each encompass thirty degrees on the arc of the wheel, and the five smaller segments with jokers 2 each encompass twelve degrees of the arc of the wheel.

Figure 3:
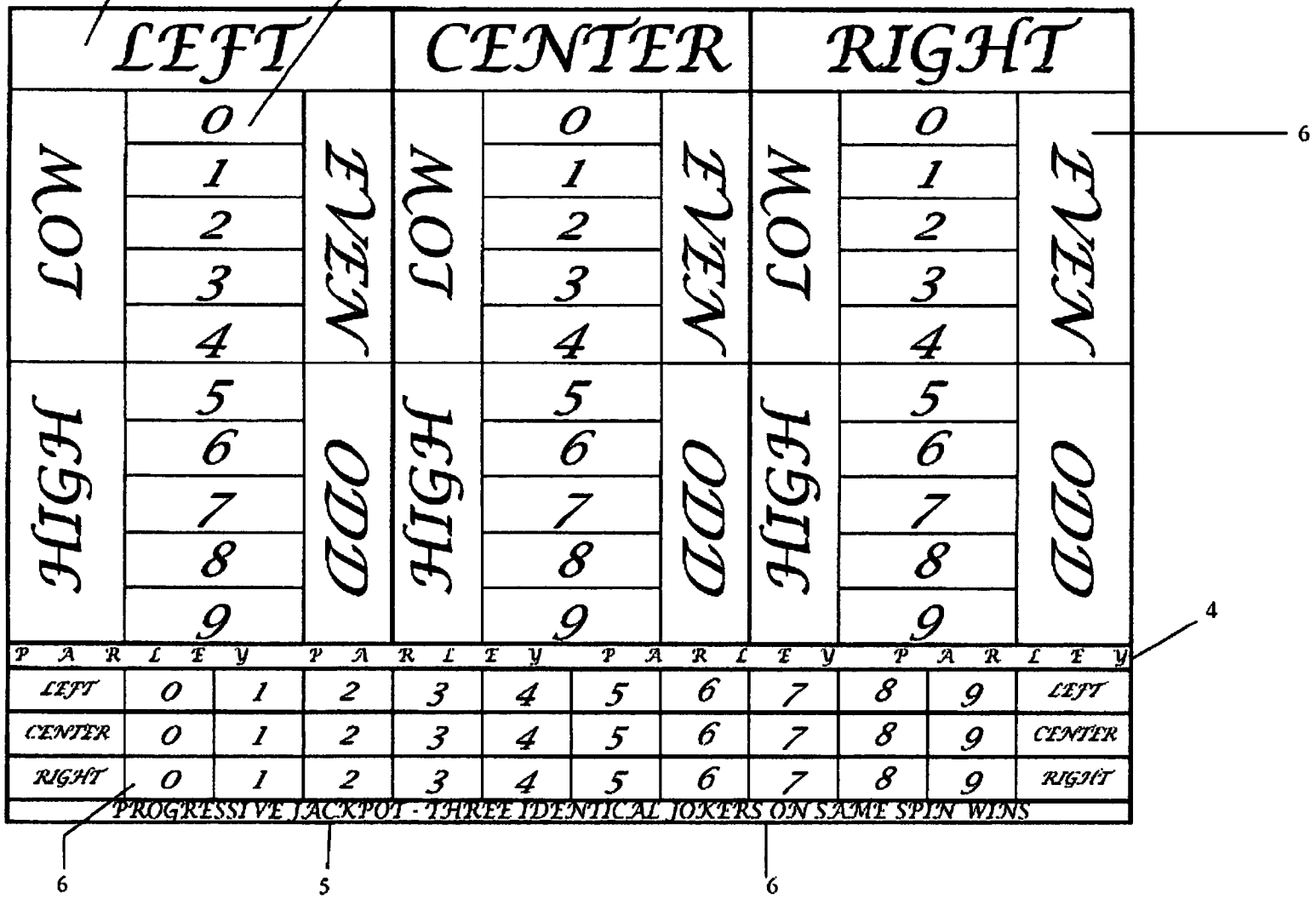
FIG. 3 shows a preferred embodiment of the game board for either a table game or a representation of a table for an electronic game, hybrid game, computer game or board game wherein different groups are further divided into wagering zones and each wagering zone is associated with a wagering option.

FIG. 3 shows a preferred embodiment of the game board for either a table game or a representation of a table for an electronic game, hybrid game, computer game or board game, wherein there are three wagering groups including independent wagering groups 3, a parlay wagering group 4 and a progressive wagering group 5. The independent wagering groups 3 and parlay wagering group 4 are further divided into wagering zones 6 and each wagering zone 6 is associated with a value or wagering option corresponding to predetermined pay out odds. Progressive wagering group 5 consists of one wagering zone 6.

The three independent wagering groups 3 with headings LEFT, CENTER and RIGHT in FIG. 3 correspond to three random event generators situated in a row from left to right. A player would place a wager in the left group for an independent bet corresponding with the left random event generator from the viewpoint of the player. Similarly, the center independent wagering group 3 corresponds to a center random event generator and the right independent wagering group 3 corresponds to a right random event generator. Similarly, the parlay wagering group 4 is divided into LEFT, CENTER and RIGHT sections, each containing wagering zones 6 for placement of parlay bets.

In FIG. 3 independent wagering zones 6 include numbers from zero (0) through nine (9), Odd (1-3-5-7-9), Even (0-2-4-6-8), High (5-6-7-8-9), Low (0-1-2-3-4), Parlay wagering zones 6 with numbers from zero (0) through nine (9), and a Progressive wagering zone 6. Although not displayed in this figure, parlay and independent wagering zones may also include additional wagering options including Any Low Odd (1-3), Any High Odd (5-7-9), Any Low Even (0-2-4), and Any High Even (6-8).

The payout odds for different wagers can vary at the discretion of the operator, such as a casino or parlor. One envisioned payout scheme would calculate payout odds depending on actual odds without jokers. Calculating payout odds in this manner would be favorable for many reasons. Firstly, exclusion of the jokers would remove difficult mathematical payout calculations to allow for payment in round numbers. Additionally, exclusion of jokers in computing payout odds would give the house an edge, and would be appealing to operators controlling the game.

For example, payout odd calculations computed without jokers in the table game layout of FIG. 3 would be as follows. An independent wager on any one of the numbers from zero (0) through nine (9), would have payout odds of 10:1, in which a player that bets $10 would win $100 on a successful wager. A successful independent wager on an odd, even, high or low wagering zone would have payout odds of 1:1; wherein zero (0) is even and five (5) is high. A bet on an odd, even, high or low wagering zone in the amount of $10 would pay $10. Parlay bets would pay 10:1 for a single bet on any one wager from zero (0) through nine (9). Further, parlay payout odds in the embodiment of FIG. 3 would be easy to calculate, as each additional random event generator bet on would increase the odds for a successful wager by a factor of ten. Therefore, just as a bet placed on one random event generator with wagering zones from zero (0) through nine (9) would payout at a rate of 10:1, two bets on two random event generators with wagering zones from zero (0) through nine (9) would payout at a rate of 100:1 for successful wagers. Additionally, wagering in parlay on three random event generators each with wagering zones of zero (0) through nine (9) would pay out at 1,000:1. Payouts for parlay bets placed on the combination of four random event generators would be 10,000:1, five random event generators would be 100,000:1 and so on. Importantly, parlay wagers placed on the outcome of a combination of random events simultaneously created from more than one random event generator must match each random event in which a parlay wager was placed in order to be successful and pay out winnings. Therefore, a parlay wager based on the outcome of four random events would not be successful and would not pay out any winnings even if three random events generated match three of the four events chosen in the parlay wager but one does not.

In an alternative game board setup containing wagering options including Any Low Odd (1-3), Any High Odd (5-7-9), Any Low Even (0-2-4), and Any High Even (6-8), payout odds for a wager on a low odd or a high even would be 5:1, and payout odds for a wager on high odd or low even bets would be 10:3.

The progressive wagering zone 6 in FIG. 3 wins when some event occurs, such as when three jokers of the same color are simultaneously generated by three random event generators. A successful progressive wager is paid out in the value of the progressive jackpot, and is not calculated based on mathematical payout odds. Instead, the progressive payout is paid out according to rates determined by the operator and increased by a percentage of each wager placed by all players at all connected stations who are either playing at the same table, group of linked tables, linked computers, or at one or more machines linked together. If more than one player wins the progressive bet for a particular round of the game, the progressive jackpot is split among all successful progressive bet players who participated for that particular round of the game.

Figure 4:
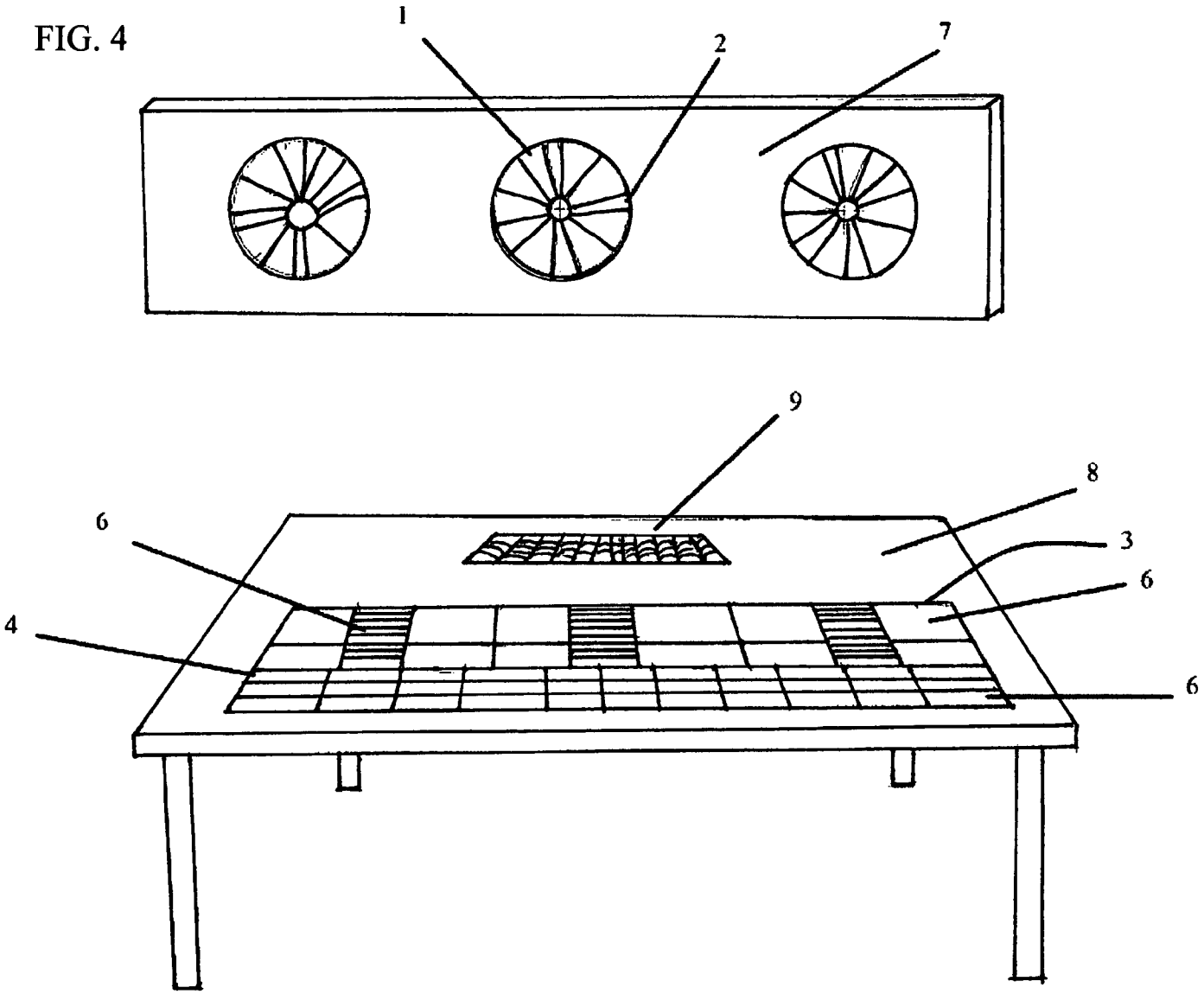
FIG. 4 depicts a preferred embodiment of the game using three physical wheels able to simultaneously generate multiple random events in a table game format.

FIG. 4 displays a table game embodiment of the invention. For simplicity, the table game in FIG. 4 is drawn with three vertically oriented wheels to be used as random event generators. The number of event generators and form of event generators can be varied.

The table game in FIG. 4 contains a random event generator area 7, with the random event generators there upon, in the form of a physical wheel display made up of three vertical wheels. The wheels contain wider radial sections 2 and more narrow radial sections 3, each containing values or symbols.

The drawing in FIG. 4 further displays that the table 8 would have a game board on its upper surface with independent wagering groups 3 and parlay wagering groups 4, each further divided into wagering zones 6. Players would place bets on wagering zones 6 on the table 8 in order to participate in the game. Chips, money and the like would be held and monitored at the table, in a holding station 9, such as depicted in the drawing.

In a table game layout, an attendant would operate the wheels or random event generators and monitor the gaming. Operation of wheels could be manually, to spin them, or pushing a lever, button or device that controls their movement, causing them to spin. The attendant would also monitor gaming by counting money, dispensing chips and paying out successful wagers according to payout odds.

Figure 5:
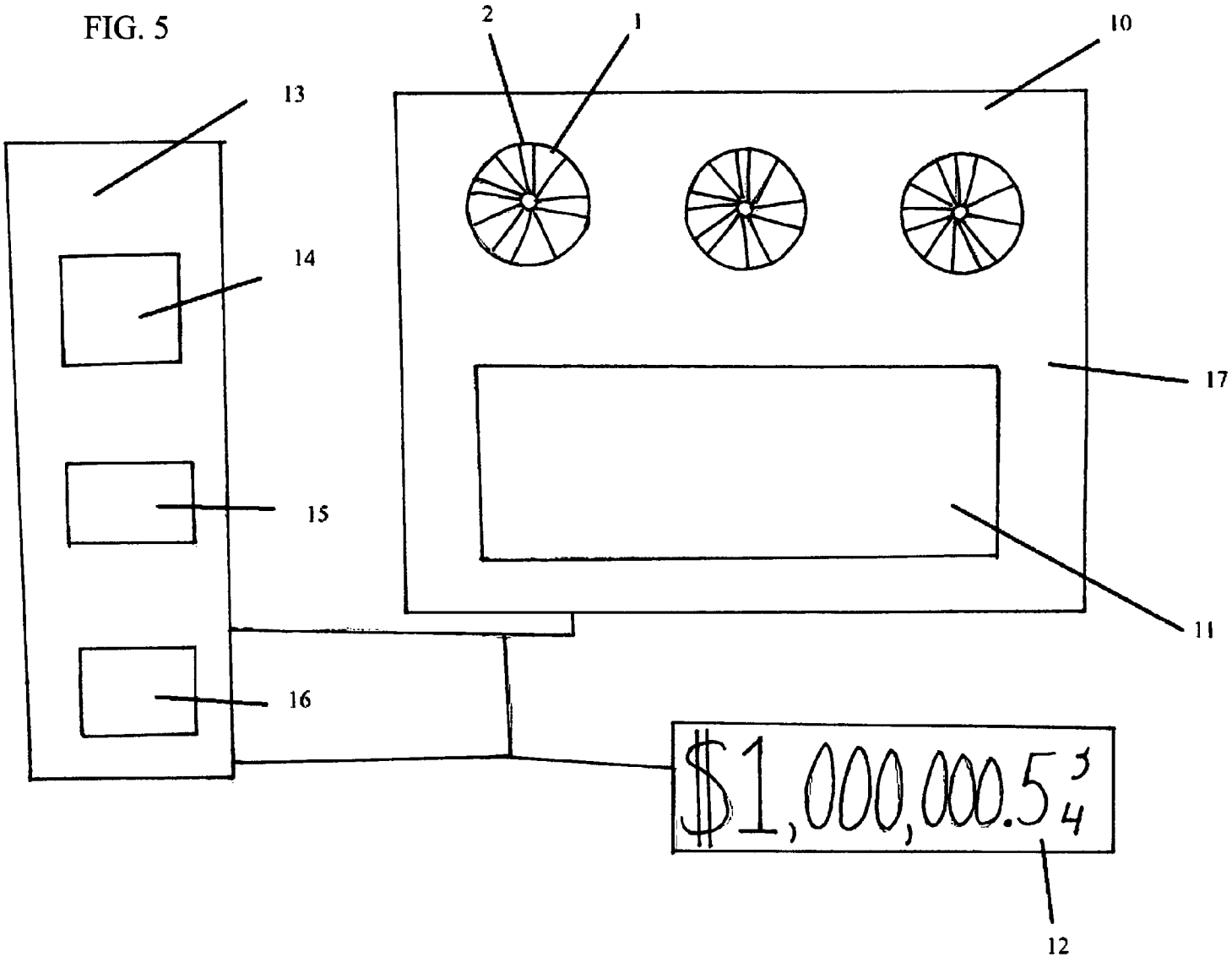
FIG. 5 displays an electronic version of the game, with electronic wheel display, an electronic touch screen table representation, a progressive display, a central processing unit, memory, a processor and random number generators.

FIG. 5 depicts an electronic version of the game. The electronic game includes a computer terminal 18 connected to a player terminal 17. Various components make up the player terminal 17, including a playing surface 11, in the form of a touch screen 11 in the drawing, and an electronic display 10. The electronic display 10 includes the electronic representations of the random event generators, depicted as wheels in FIG. 5 divided into wider radial sections 1 and more narrow radial sections 2, each containing numbers or symbols. The playing surface 11, in the form of a touch screen, is a two dimensional representation of the gaming board layout. The electronic game would include an electronic progressive display 12 displaying the current amount of the jackpot. The progressive display 12 could display the growing progressive jackpot in an electronic sign over the player terminal 17. The progressive display 12 on a particular turn will show the amount of the progressive jackpot ticking upwards in a manner similar to the odometer. The progressive display 12 in FIG. 5 is $1,000,000.53, ticking upward to $1,000,000.54.

The computer terminal 18 in FIG. 5 is made up of a central processing unit 13, memory 14 for storing data, a processor 15, and at least one random event generator 16. The central processing unit 13 communicates with the player terminal and progressive display.

In the current embodiment, a player would sit down at the player terminal 17 of the electronic machine and insert cash, a voucher, or a credit card. The amount that the player inserts into the machine will be converted into credits depending on the value of the machine ($0.01, $0.02, $0.05, etc.). At an electronic gaming machine a player would have to place an independent or parlay bet on the touch screen playing surface 11 layout (or through using a keyboard) and would then have the option of making a progressive jackpot wager. After a player completes all wagers, that player can push a button, either on the screen or the machine that will cause the display 10 screen to display simultaneous spinning wheels. The wheels will eventually come to rest and an indicator will select a radial section in each wheel activated and the particular section will be controlled by at least one random event generator 16, often in the form of pseudo-random number generator(s). After the random events are generated selecting numbers or symbols, the machine will then determine whether a player wins or loses and will award the appropriate amount of credits to winning wagers placed after calculating payout odds and any progressive jackpots. Following play, a player may place another wager or cash out and receive either cash or a voucher in the amount that the player still has available on the machine.

The electronic game in FIG. 5 can include two or more gaming machines linked to one another, with a central processing unit 13 for performing the reception and transmission of game data between one player's gaming machine terminal 17 and the other grouped gaming machine terminals 17, wherein the system transmits progressive wager information corresponding to progressive wagers placed by players at remote gaming terminals 17 to a central processing unit 13 with memory 14 and at least one processor 15 at the computer terminal 18. The computer terminal 18 receives data corresponding to the outcome received from the central processing unit 13, where the outcome was generated by a plurality of random event generators. Information from the gaming terminals 17 and the random event generated outcomes are transmitted to the central processing unit 13, which calculates the amount of players that won the progressive jackpot for that turn of game play and divides the progressive jackpot stored in the memory 14 by the number of said winning players for that turn of game play. Then the central processing unit 13 transmits this data concerning how much of a prize was or was not won to the remote players terminals 17.

Figure 6:
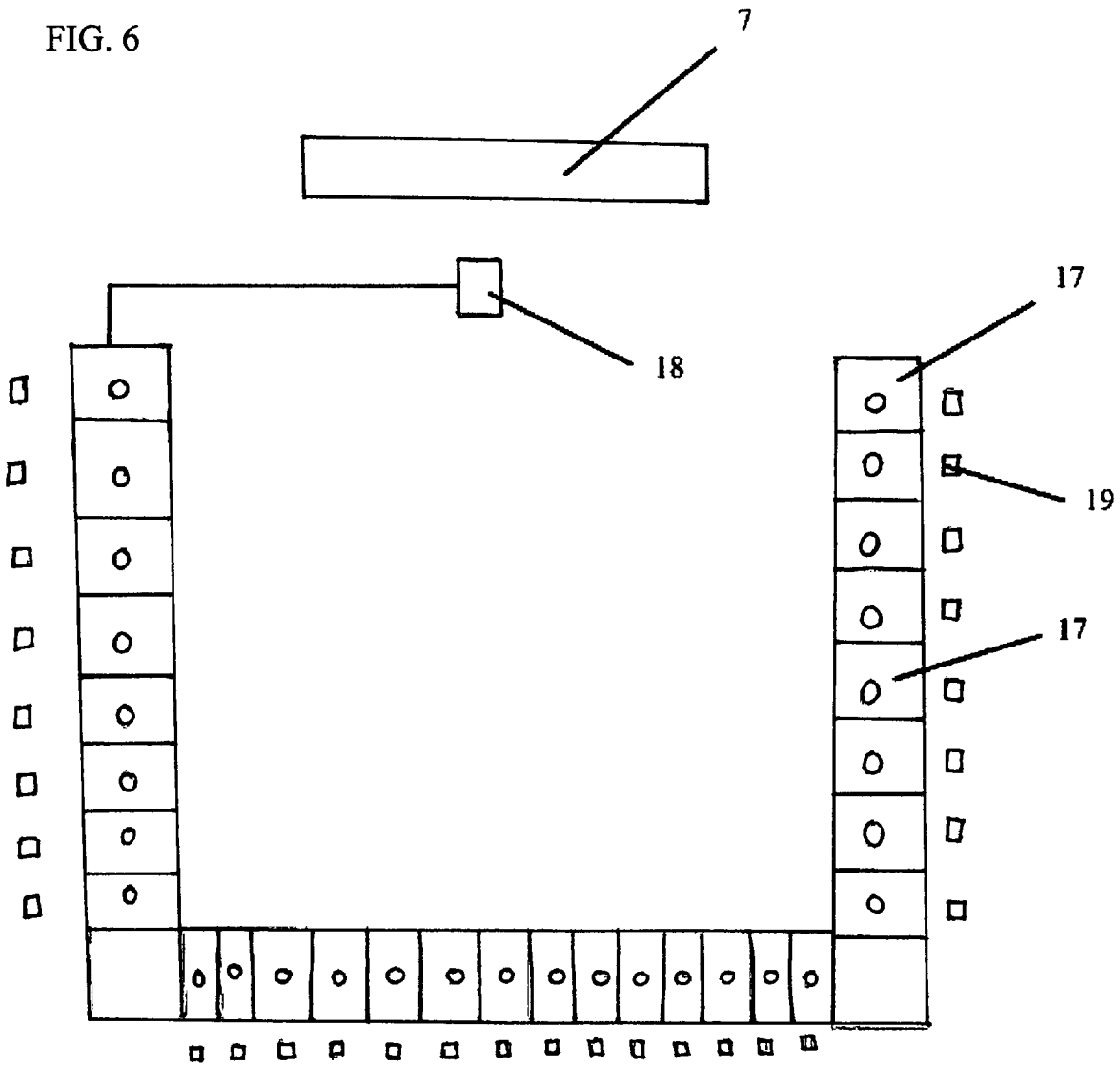
FIG. 6 shows a representation of the hybrid game, wherein physical random number generating elements, such as a physical wheel display, are connected to electronic gaming machines.

A hybrid game is depicted in FIG. 6, which includes a physical random event generator area 7 coupled with an electronic gaming area including electronic player terminals 17 connected to an electronic computer terminal 18. In the hybrid game setup drawn in FIG. 6, the event generator area 7, with the random event generators there upon may be in the form of a physical wheel display. In one embodiment of the invention, the attendant can spin the wheels, and then input the outcome of the wheels into the computer terminal 18. FIG. 6 shows player terminals 17 with seats 19, for players to comfortably sit as they play the game. The hybrid game incorporates many of the features of the electronic game, including the central processing unit, memory, a processor and an electronic touch screen (or keyboard) and touch screen display. However, the hybrid game adds the feature of a physical random event generator, such as wheels or air-mix style random number generators, rather than pseudo-random number generators, like those optimally used in fully electronic gaming machines. In a hybrid game, the attendant will activate a physical display 7 of random event generators, such as wheels which will generate outcomes. Then either the attendant or a sensor will transfer the wheel outcome into the computer terminal 18 which will communicate with individual player terminals 17, which will calculate the outcome the bets placed by players at the player terminals 17.

Although specific embodiments of the present invention have been shown and described herein, it will be apparent to those skilled in the pertinent art that alterations and modifications may be made while still being in the same broader concept of this invention.

I claim:

1. A computer-implemented method of playing a wagering game, including at least one computer processor, comprising the steps of:

a. providing a first wheel for generating a first random outcome, the first wheel consisting of a first set of numeric symbol outcomes and a first set of non-numeric symbol outcomes, a second wheel for generating a second random outcome, the second wheel consisting of a second set of numeric symbol outcomes and a second set of non-numeric symbol outcomes, and a third wheel for generating a third random outcome, the third wheel consists of a third set of numeric-symbol outcomes and a third set of non-numeric symbol outcomes;

b. providing a game board comprising an independent wagering group, a parlay wagering group, and a progressive wagering group, wherein the independent wagering group includes a first set of independent wagering zones corresponding to only the first set of numeric symbol outcomes, a second set of independent wagering zones corresponding to only the second set of numeric symbol outcomes, and a third set of independent wagering zones corresponding to only the third set of numeric symbol outcomes, wherein said parlay wagering group includes a first set of parlay wagering zones corresponding to only the first set of numeric symbol outcomes, a second set of parlay wagering zones corresponding to only the second set of numeric symbol outcomes, and a third set of parlay wagering zones corresponding to only the third set of numeric symbol outcomes;

c. accepting at least one base wager placed on any one of the first set of independent wagering zones, the second set of independent wagering zones, the third set of independent wagering zones, or the parlay wagering group, wherein when the at least one base wager is placed on the parlay wagering group, the at least one base wager includes a first parlay bet on one of the first, second or third sets of parlay wagering zones, and a second parlay bet on a different one of the first, second or third sets of parlay wagering zones, wherein the base wager cannot be placed for the first set of non-numeric outcomes, the second set of non-numeric outcomes, or the third set of non-numeric outcomes;

d. providing an option of placing a progressive wager on the progressive wagering group when the at least one base wager has been accepted;

e. simultaneously generating the first random outcome using the first wheel, the second random outcome using the second wheel, and the third random outcome using the third wheel;

f. via the computer processor, determining an independent wager win, wherein the independent wager win only occurs when there is an independent wager match between the at least one base wager placed on the first set of independent wagering zones and the first random outcome, the at least one base wager placed on the second set of independent wagering zones and the second random outcome, or the at least one base wager placed on the third set of independent wagering zones and the third random outcome, g. via the computer processor, determining a parlay wager win, wherein the parlay wager win only occurs when at least two of the first, second and third parlay wagering zones are bet upon and at least two parlay wager matches occur, wherein the at least two parlay wager matches are selected from the group comprising the first parlay bet matching the first random outcome, the second parlay bet matching the second random outcome, and the third parlay bet matching the third random outcome;

h. via the computer processor, determining a progressive wager win, wherein the progressive wager win only occurs when the first random outcome is a first non-numeric symbol, the second random outcome is a second non-numeric symbol, the third random outcome is a third non-numeric symbol, and the first non-numeric symbol matches both the second non-numeric symbol and the third non-numeric symbol;

i. paying out the independent wager win according to predetermined independent wager payout odds for the independent wager win;

j. paying out the parlay wager win according to pre-determined parlay wager payout odds;

k. paying out the progressive wager win, wherein said progressive wager win payout is funded by a percentage of any wagers placed; and l. clearing all wagers and initiating another round of game play.

2. The computer-implemented method of playing a wagering game as in claim 1 wherein the first wheel is a first physical wheel, the second wheel is a second physical wheel, and the third wheel is a third physical wheel.

3. The computer-implemented method of playing a wagering game as in claim 2, further comprising the step of: providing one or more additional wheels, wherein each of the one or more additional wheels generate corresponding additional random outcomes and consists of corresponding additional sets of numeric symbol outcomes and corresponding additional sets of non-numeric symbol outcomes.

4. The computer-implemented method of playing a wagering game as in claim 3, wherein the independent wagering group further includes additional corresponding independent wagering zones corresponding to only the corresponding additional sets of numeric symbol outcomes, and wherein said parlay wagering group further includes additional corresponding sets of parlay wagering zones corresponding to only the corresponding additional sets of numeric symbol outcomes.

5. The computer-implemented method of playing a wagering game as in claim 4, further comprising the step of accepting another base wager placed on any one of the first set of independent wagering zones, the second set of independent wagering zones, the third set of independent wagering zones, the additional corresponding sets of independent wagering zones or the parlay wagering group, wherein the another wager on the parlay wagering group includes at least two of the following: another first parlay bet on the first set of parlay wagering zones, another second parlay bet on the second set of parlay wagering zones, another third parlay bet on the third set of parlay wagering zones, and an additional parlay bet on a corresponding additional set of parlay wagering zones, wherein the base wager cannot be placed for the first set of non-numeric outcomes, the second set of non-numeric outcomes, the third set of non-numeric outcomes, or the corresponding additional sets of non-numeric outcomes.

6. The computer-implemented method of playing a wagering game as in claim 1 wherein the first wheel is a first computerized electronic representation of a wheel, the second wheel is a second computerized electronic representation of a wheel, and the third wheel is a third computerized electronic representation of a wheel.

7. The computer-implemented method of playing a wagering game as in claim 6, further comprising the step of: providing one or more additional wheels, wherein each of the one or more additional wheels generates additional corresponding random outcomes and consists of additional corresponding sets of numeric symbol outcomes and additional corresponding sets of non-numeric symbol outcomes.

8. The computer-implemented method of playing a wagering game as in claim 7, wherein the independent wagering group further includes additional corresponding independent wagering zones corresponding to only the additional corresponding sets of numeric symbol outcomes, wherein said parlay wagering group further includes additional corresponding sets of parlay wagering zones corresponding to only the additional corresponding sets of numeric symbol outcomes.

9. The computer-implemented method of playing a wagering game as in claim 8, further comprising the step of accepting another base wager placed on any one of the first set of independent wagering zones, the second set of independent wagering zones, the third set of independent wagering zones, the additional corresponding sets of independent wagering zones, or the parlay wagering group, wherein the another base wager on the parlay wagering group includes at least two of the following: another first parlay bet on the first set of parlay wagering zones, another second parlay bet on the second set of parlay wagering zones, another third parlay bet on the third set of parlay wagering zones, and an additional parlay bet on a corresponding additional set of parlay wagering zones, wherein the base wager cannot be placed for the first set of non-numeric outcomes, the second set of non-numeric outcomes, the third set of non-numeric outcomes, or the corresponding additional sets of non-numeric outcomes.

10. The computer-implemented method of playing a wagering game as in claim 1, wherein the first set of independent wagering zones include numbers from zero (0) through nine (9), Odd (1-3-5-7-9), Even (0-2-4-6-8), High (5-6-7-8-9), and Low (0-1-2-3-4) corresponding to only the first set of numeric symbol outcomes, the second set of independent wagering zones include numbers from zero (0) through nine (9), Odd (1-3-5-7-9), Even (0-2-4-6-8), High (5-6-7-8-9), and Low (0-1-2-3-4) corresponding to only the second set of numeric symbol outcomes, and the third set of independent wagering zones include numbers from zero (0) through nine (9), Odd (1-3-5-7-9), Even (0-2-4-6-8), High (5-6-7-8-9), and Low (0-1-2-3-4) corresponding to only the third set of numeric symbol outcomes.

* * * * *